US006814327B1

(12) United States Patent
Myer, II

(10) Patent No.: US 6,814,327 B1
(45) Date of Patent: Nov. 9, 2004

(54) SUPPORT FOR HOLDING AND SECURING VACUUM AND PRESSURE HOSES ASSOCIATED WITH A CARPET CLEANING SYSTEM

(76) Inventor: John D. Myer, II, P.O. Box 5160, Hilton Head Island, SC (US) 29938

( * ) Notice: Subject to any disclaimer, the term of this patent is extended or adjusted under 35 U.S.C. 154(b) by 105 days.

(21) Appl. No.: 10/125,230

(22) Filed: Apr. 18, 2002

(51) Int. Cl.[7] ..... B65H 57/12

(52) U.S. Cl. ..... 242/397.5; 242/615.2; 242/615.3; 137/355.17; 137/355.26; 254/403; 254/405

(58) Field of Search ..... 242/397, 397.5, 242/548, 615, 615.2–615.3, 472.8, 157 R, 390.8, 397.3; 248/75; 137/355.12, 355.17, 355.26, 355.27; 254/403, 405, 134.3 PA

(56) References Cited

U.S. PATENT DOCUMENTS

| | | | | | |
|---|---|---|---|---|---|
| 212,876 | A | | 3/1879 | Waterworth | |
| 3,401,420 | A | * | 9/1968 | Lofgren | 15/323 |
| 3,837,623 | A | * | 9/1974 | Chadwick, Jr. | 254/134.3 PA |
| 3,905,581 | A | * | 9/1975 | Chadwick, Jr. | 254/393 |
| 4,201,369 | A | * | 5/1980 | Betta | 242/157 R |
| 4,301,994 | A | * | 11/1981 | Lindsey | 254/134.3 PA |
| 4,549,723 | A | * | 10/1985 | Castilano | 254/405 |
| 4,592,519 | A | | 6/1986 | Peacock | |
| 4,632,364 | A | * | 12/1986 | Smith | 254/405 |
| 4,708,321 | A | * | 11/1987 | Niskin | 254/397 |
| 4,714,380 | A | * | 12/1987 | Coutarel | 405/168.3 |
| 4,872,554 | A | | 10/1989 | Quernemoen | |
| 5,033,690 | A | | 7/1991 | McIver | |
| 5,119,843 | A | * | 6/1992 | Keenan | 137/355.23 |
| 5,373,226 | A | | 12/1994 | Kimura | |
| 5,402,551 | A | * | 4/1995 | Workhoven et al. | 15/315 |
| 5,427,574 | A | | 6/1995 | Donnelly-Weide | |
| 5,573,226 | A | | 11/1996 | Smith | |
| 5,735,505 | A | * | 4/1998 | Walton | 254/134.3 PA |
| 5,740,581 | A | * | 4/1998 | Harrelson, II | 15/314 |
| 5,740,582 | A | * | 4/1998 | Harrelson, II | 15/315 |
| 5,853,142 | A | | 12/1998 | Anderson | |
| 6,113,039 | A | * | 9/2000 | Riffle | 248/75 |
| 6,209,893 | B1 | | 4/2001 | Ferris | |
| 6,382,241 | B1 | * | 5/2002 | Setrum | 137/355.22 |
| 6,540,207 | B1 | * | 4/2003 | Barnes | 254/134.3 R |

* cited by examiner

*Primary Examiner*—Kathy Matecki
*Assistant Examiner*—Sang Kim
(74) *Attorney, Agent, or Firm*—Coats & Bennett, PLLC

(57) ABSTRACT

A method and apparatus for securing a vacuum hose and a pressure hose of a carpet cleaning system to a support. In one embodiment, the support is secured to a railing structure of a building or dwelling. The vacuum hose and pressure hose are extended from a base unit to the support which is secured to the railing structure. Both the vacuum hose and the pressure hose are secured or clamped within the support such that both hoses are supported and held intermediately between the base unit and an application wand. This method of supporting vacuum and pressure hoses of a carpet cleaning system is particularly useful when cleaning floors and carpets on levels above ground.

33 Claims, 6 Drawing Sheets

SUPPORT FOR HOLDING AND SECURING VACUUM AND PRESSURE HOSES ASSOCIATED WITH A CARPET CLEANING SYSTEM

FIELD OF THE INVENTION

The present invention relates to floor and carpet cleaning systems, and more particularly to a support structure for holding and supporting pressure and vacuum hoses that form a part of such a floor or carpet cleaning system. More particularly, the present invention relates to a support device that is adapted to be secured to a railing structure of a building such that the pressure and vacuum hoses can be secured to the support structure while the same is attached to a railing structure.

BACKGROUND OF THE INVENTION

Floor and carpet cleaning systems are widely used to clean carpets and floors. Typically, a carpet cleaning system will include a base unit, a pair of hoses including a vacuum hose and a pressure hose, and an application wand. Often, a base unit will be a mobile unit including a system for heating and pressurizing a rinse or extraction solution that is ultimately delivered to the floor or carpet. The pressure and vacuum hoses connect to the base unit and extend therefrom. The terminal ends of the vacuum and pressure hoses are connected to an application wand. In many carpet-cleaning methods, a carpet cleaning solution is first sprayed on the carpet. After a certain period of time has passed, the operator then directs the wand over the carpet. In conventional fashion, by engaging a trigger on the wand, a rinse solution from the base unit is directed through the pressure hose and out the wand. Typically, this rinse solution has been heated and is under pressure. The wand is then repeatedly pulled over the rinsed areas of the carpet. The rinse solution is sucked from the carpet through the vacuum hose and returned to the outside base unit.

Carpet and floor cleaning is relatively easy where the floor or carpet is located on a ground level and where the operator can position the base unit relatively close to the floor or carpet being cleaned. However, the difficulty increases substantially when the operator is required to clean the floor or carpet located on a second story or above. Somehow, the operator has to run or extend the hoses to the second or third story, for example. This means that hose segments are coupled together and in the end each hose is of a substantial length, sometimes extending over one hundred feet, for example. In many cases, carpet-cleaning operators find themselves cleaning second, third, and fourth floor dwellings that include a balcony with a railing structure. In these cases, it is important to secure the hoses to the railing structure such that the operator and the wand can freely move about to clean the floor or carpet on such an upper story. Typically, an operator attempts to secure the vacuum and pressure hoses someway to the railing structure. It is known to use hose hooks that simply hook the hose to an adjacent structure. However, these are not reliable and are very difficult to use. In addition, these hooks tend to slip and are easily lost. In many cases, the operator will attempt to weave the hoses through the vertical banisters of the railing structure so as to effectively secure the hoses to the railing structure. Again, this is very difficult to accomplish and leads to even more problems. In weaving the hoses through the banisters of the railing structure, it is easy to damage portions of the railing structure such as by causing paint to be chipped from the railing structure or the railing structure to be scarred, bruised or even scratched. In addition, this manner of attaching the hoses to the railing structure is not sound or foolproof. Often, the weave connection will breakdown and the hoses will automatically fall to the ground and in the process, will, of course, pull on the wand until it can be stabilized.

Another problem involved in carpet cleaning, is that during the carpet cleaning operation the vacuum hose tends not to be stable but to jerk and vibrate as the wand is moved from dry areas to heavy saturated areas of the floor. This jerking movement of the vacuum hose again tends to scar, scratch and generally damage the structure of the building laying adjacent the vacuum hose during this time.

Therefore, there has been and continues to be a need for a support structure that is specifically designed to hold and secure the vacuum and pressure hoses of a carpet cleaning system.

SUMMARY OF THE INVENTION

The present invention entails a support for supporting a vacuum hose and a pressure hose that form a part of a carpet cleaning system. In one embodiment of the present invention, the support includes a base for resting adjacent a railing structure or other structure associated with a building. At least one connector is associated with the base for connecting the support to the railing structure or other associated structure of the building. The support includes a frame structure including an area for receiving the vacuum hose and an area for receiving the pressure hose. A fastener or clamp is provided for securing the vacuum hose and pressure hose of the carpet cleaning system within the areas that receive and hold the vacuum and pressure hoses.

In one particular embodiment, the support includes a moveable clamp that is moveable between a clamped position and an unclamped position. In a clamped position, the clamp engages both the vacuum hose and pressure hose and secures both within the support.

Still in another embodiment of the present invention, the support includes a reel for receiving and supporting the vacuum hose and a ledge or other support structure for receiving and holding the pressure hose. The clamp may be moveably mounted to the support such that in the clamped position, a portion of the clamp extends over and engages a top portion of both the vacuum hose and the pressure hose so as to hold both hoses within the support.

In addition, the present invention entails a method of receiving and supporting the vacuum and pressure hoses. In one embodiment, one hose is dropped downwardly from an area where the support is stationed. The hose that is dropped downwardly is secured to the other hose and the two hoses are together pulled towards the support. Thereafter, each hose is secured within the support. After securement, the floor or carpet cleaning operation can be commenced and because the hoses are securely held within the support, it follows that a wand coupled to the hoses is free to be moved over a floor or carpet for the purpose of cleaning. Once the carpet cleaning operation is concluded, the pressure hose and vacuum hose can be released from the support.

Other objects and advantages of the present invention will become apparent and obvious from a study of the following description and the accompanying drawings which are merely illustrative of such invention.

DESCRIPTION OF AN EXEMPLARY EMBODIMENT

Figure 6:
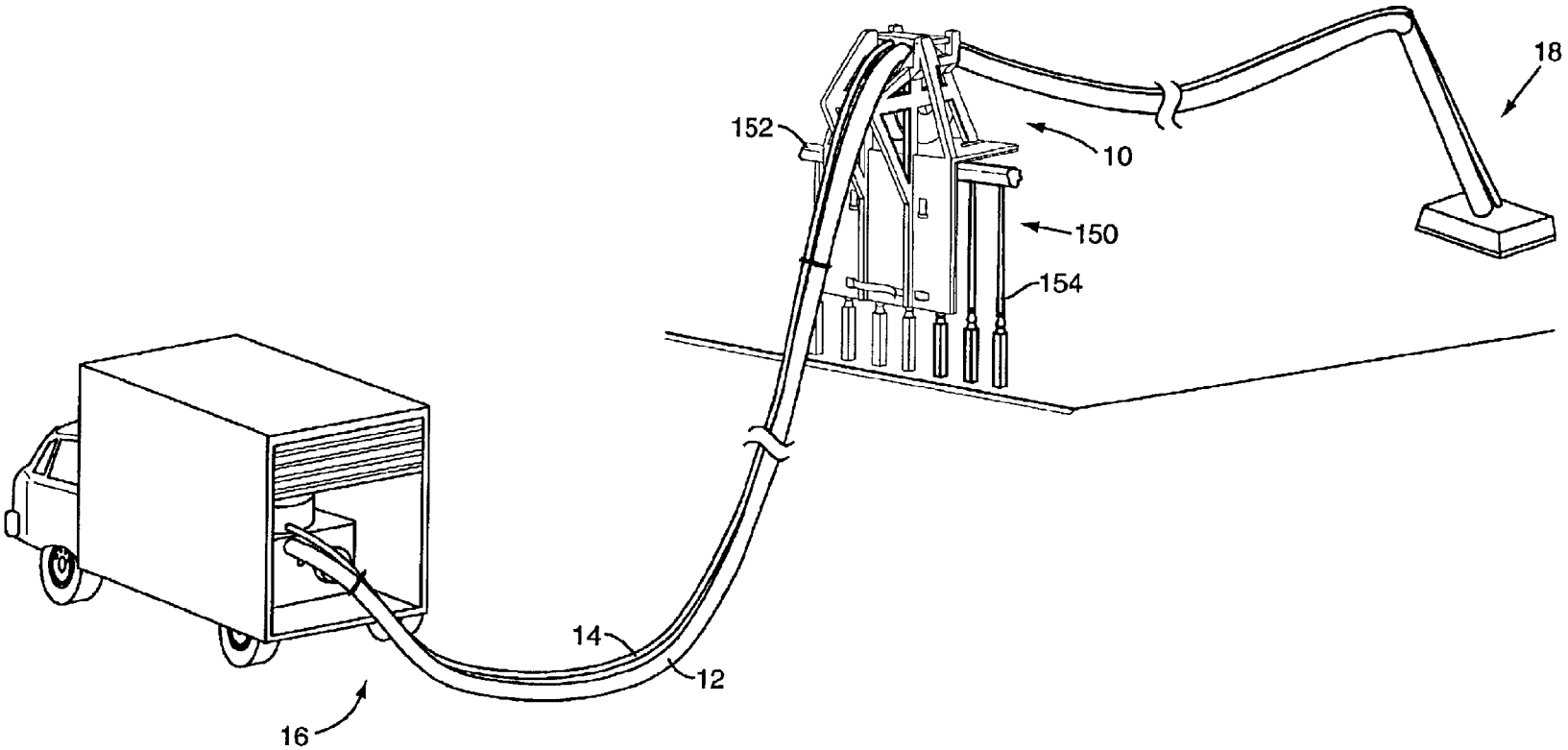
FIG. 6 is a schematic illustration of a carpet cleaning system wherein the vacuum hose and pressure hose of the system are held by the support of the present invention.

With further reference to the drawings, the support of the present invention is shown therein and indicated generally by the numeral 10. Support 10 is designed to receive and support one or more hoses of a carpet or floor cleaning system. Typically, a carpet cleaning system will involve two hoses, a vacuum hose indicated by the numeral 12 and a pressure hose indicated by the numeral 14. Further, as illustrated in FIG. 6 of the drawings, typical carpet cleaning systems will include a base unit 16 and a wand 18. Vacuum hose 12 and pressure hose 14 extend from the base unit 16 to the wand 18. In many cases, the base unit 16 will be supported and contained within a mobile vehicle such as a van or truck. The base unit 16 functions to heat and deliver under pressure a liquid solution, such as a rinse. This is typically directed from the base unit 16 to the wand 18 via the pressure hose 14. The vacuum hose 12, on the other hand, is utilized to deliver liquid and other material vacuumed or sucked-up by the wand 18 during a floor or carpet cleaning operation.

The present invention deals with providing a support structure 10 for receiving and supporting one or more hoses, such as the vacuum hose 12 and pressure hose 14, intermediately between the base unit 16 and the wand 18. As will be appreciated from subsequent portions of this disclosure, the support 10 is designed to be mounted on or supported by a portion of the structure housing the carpet or floor to be cleaned. In some cases, the support 10 will be mounted on a railing structure, indicated generally by the numeral 150 (FIG. 6). Subsequently herein, it will be explained how the support 10 is mounted to such a railing structure.

Turning to the support 10, it is seen that the same includes a base indicated generally by the numeral 20. Base 20 forms a mounting structure that enables the support 10 to be secured in a generally stationary or fixed position. In the case of the embodiment illustrated herein, the base 20 includes a generally inverted L-shape structure that can be constructed of plastic, metal, wood or any other suitable material. As illustrated in FIGS. 1–4, base 20 includes a top 22 and a side 24. As noted above, the top 22 and side 24 join to form a generally inverted L-shape. Secured to the top 22 and side 24 is a padding 26 such as a foam or rubber material that will form an interface between the base 20 and the mounting structure to which the support 10 is mounted.

Formed in side 24 is a series of openings 28. Secured within the two upper openings 28, is a pair of upper loops or flexible ties 30. Secured to the upper surface of top 22 is a pair of hook/loop fastener tabs 32 that are adapted to mate with portions of the upper loops 30. That is, each upper loop 30 includes a terminal end portion that includes a hook or loop fastener that can be secured to one of the hook/loop fastener tabs 32 formed on the upper surface of the top 22. In addition to the upper loops 30, the base 20 includes a lower loop 34. The lower loop 34 is retained within a pair of the lower openings 28 and includes hook and loop type fasteners formed on opposed ends. As will be appreciated from subsequent portions of the disclosure, the lower loop or tie 34 is adapted to extend around a series of banisters 154 that form a part of the railing structure 150. Therefore, the upper and lower loops 30 and 34 cooperate to secure the support 10 to a support structure such as the railing 150 shown in FIG. 6.

With particular reference to FIGS. 1–4, the support 10 is provided with a frame structure that is indicated generally by the numeral 50. Frame structure 50 extends upwardly from the base 20 and can be molded integrally with the base 20. Further, the fame structure 50 can be constructed of various materials such as plastic, wood, metal, etc. In any event, the frame structure includes a pair of side assemblies. With reference to the right side of the frame structure 50, as viewed in FIGS. 1 and 2, the same includes a forward support 52 that extends upwardly from the top 22 of the base 20 and which includes a lower leg extension 52*a* that, in the case of the embodiment disclosed, is molded into the side 24 of the base. Further, there is provided a rear support 54 that is spaced rearwardly from the forward support 52. A cross member 56 extends between the supports 52 and 54. Extending forwardly from the forward support 52 is a V-shaped member 58 that forms an extension of the forward member 52 and connects with the cross member 56. Finally, this side assembly of the frame structure 50 includes a diagonal member 60 that extends from an upper portion of the forward support 52 downwardly and outwardly to where the diagonal member joins the base 20.

Figure 1:
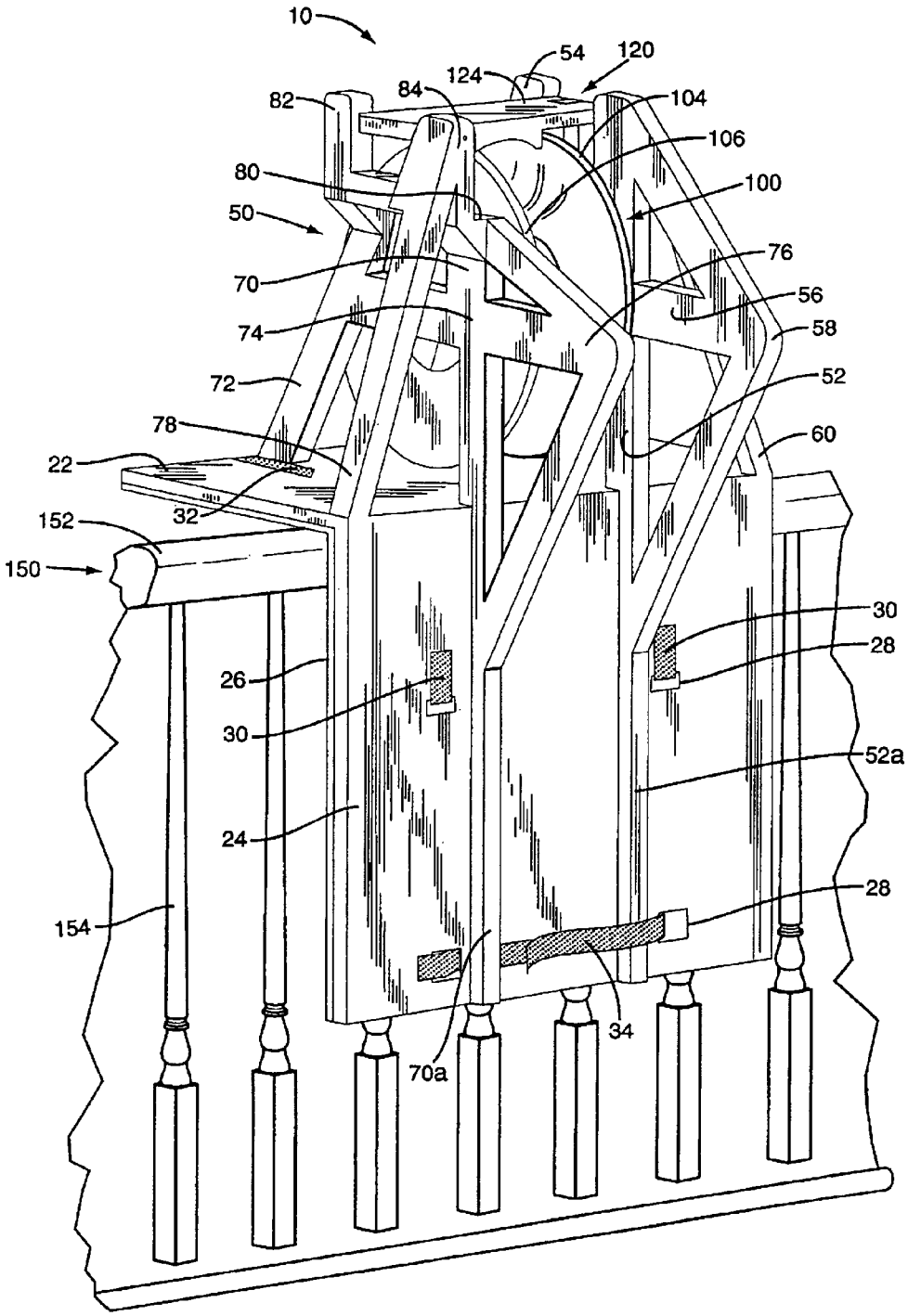
FIG. 1 is a perspective view of the vacuum hose and pressure hose support of the present invention.
Figure 2:
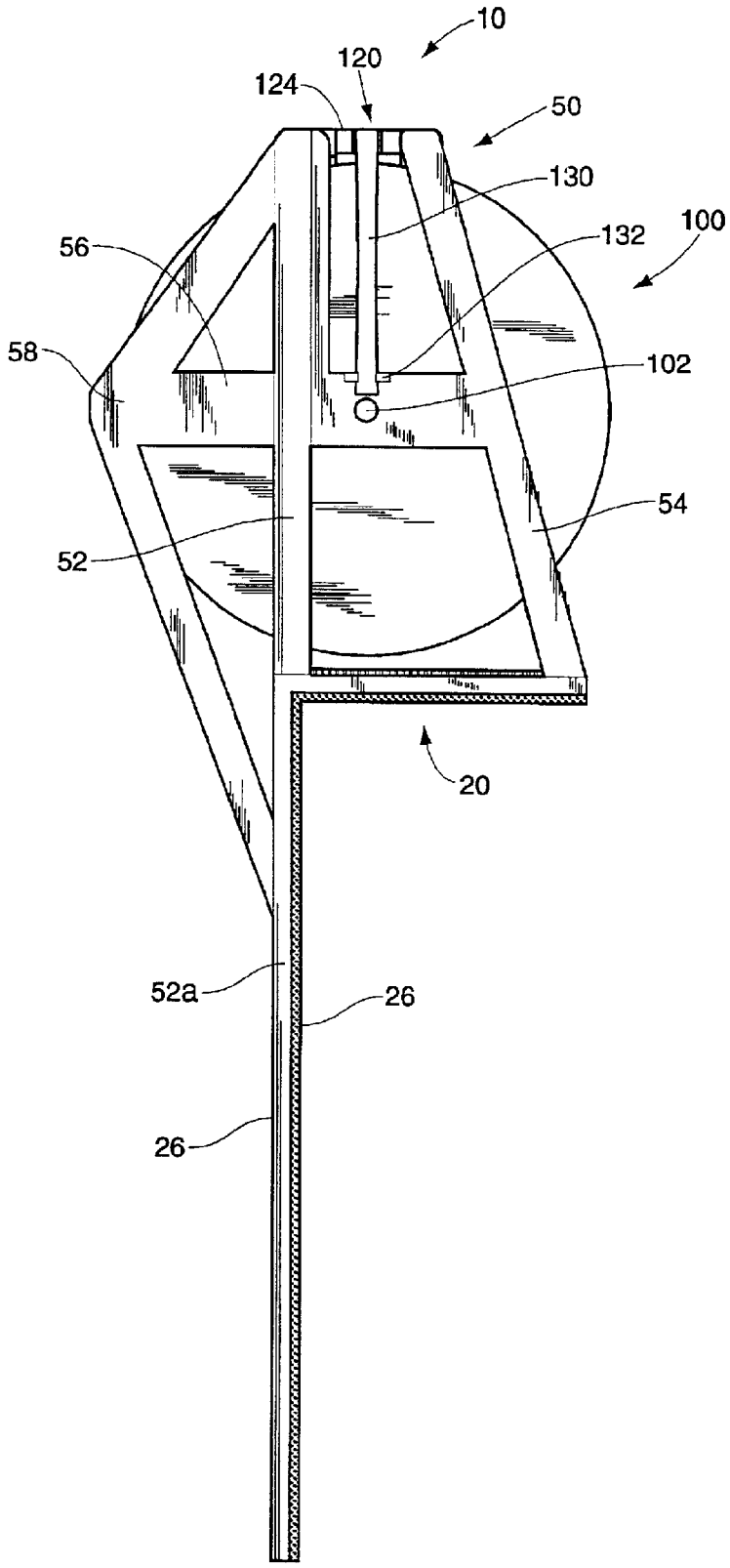
FIG. 2 is a side elevational view of the support.

Viewing the left side of the frame structure 50, as viewed in FIG. 1, the same includes a forward member 70 that extends upwardly from the base 20 and which includes an extension leg 70*a* that extends downwardly and blends into the side 24 of the base 20. Extending upwardly from the top 20 of the base is a rear member 72. A cross member 74 interconnects the forward member 70*a* and the rear member 72. A V-shaped extension 76 extends forwardly from the forward member 70 and connects with a forward end portion of the cross member 74. A diagonal member 78 extends from an upper portion of the frame structure 50 downwardly to where it joins the top 22 of the base 20.

Formed about the left side of the frame structure 50 as viewed in FIG. 1, is a ledge 80. The ledge 80 lies inwardly of a pair of legs 82 and 84 that extend upwardly from the forward and rear members 70 and 72. As will be appreciated from subsequent portions of this disclosure, the ledge 80 functions to support and underlie, in this case, the pressure hose 14 when the pressure hose is secured and held by the support 10.

Rotatably mounted within the frame structure 50 is a reel, indicated generally by the numeral 100. Reel 100 is supported by a pivot pin 102 that extends transversely between the cross members 56 and 74. Reel 100 includes a pair of opposed flanges 104 and 106. Disposed between the flanges 104 and 106 is a hub 108. Note that the hub 108 includes a surrounding concave outer surface that forms a seat 110 for receiving, in this case, the vacuum hose 12 of the carpet cleaning system.

Figure 3:
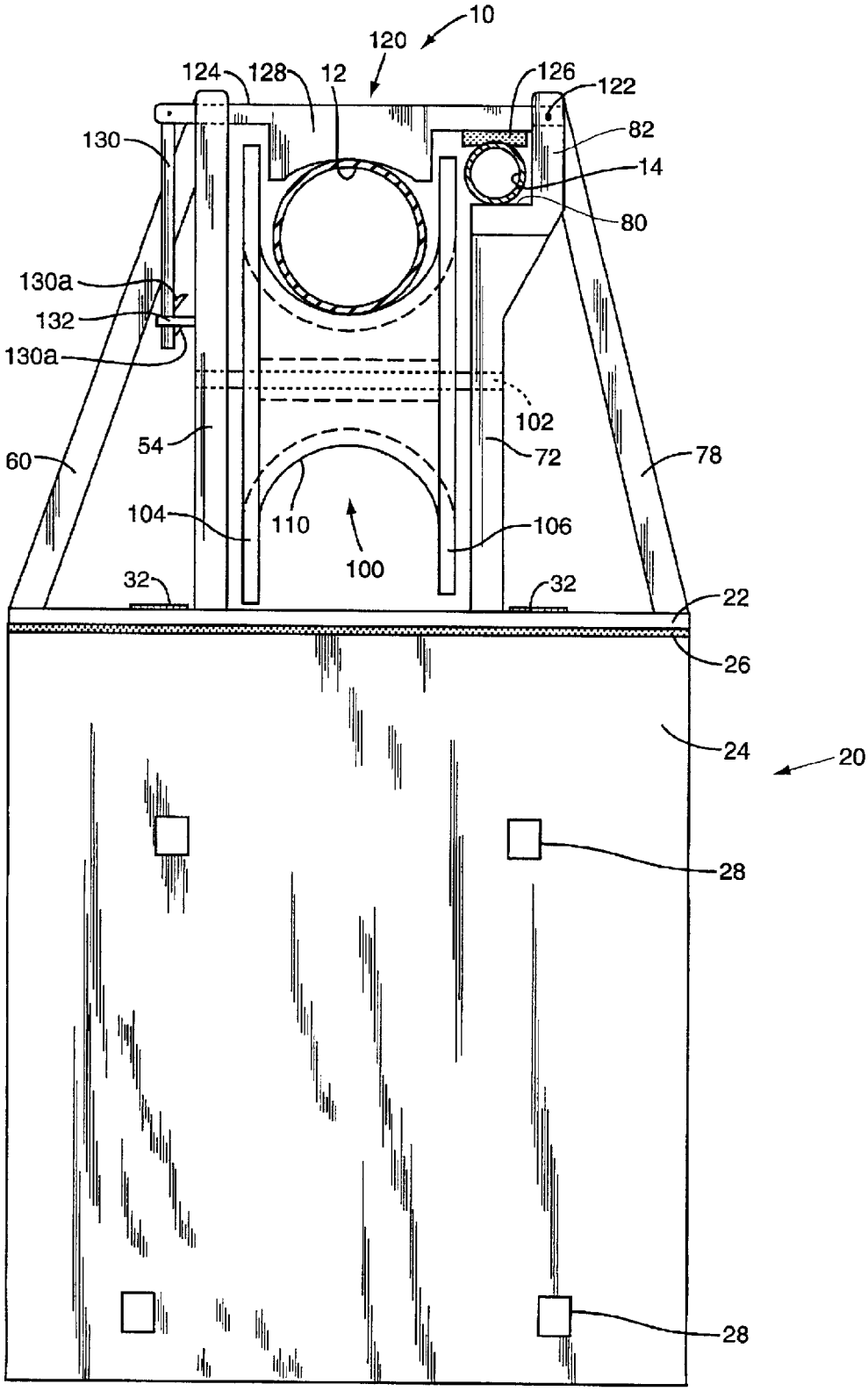
FIG. 3 is a rear elevational view of the support showing the pressure hose and vacuum hose secured within the support.

As seen in FIG. 3, the spacing of the components of the flame structure 50 in and around the areas that receive the pressure hose 14 and vacuum hose 12, are sized such that various couplings utilized on the pressure and vacuum hoses can be accommodated. Generally, in this particular design, the hoses are not pulled through the frame structure 50 when the clamp 120 is latched in the clamped position. However, it may be beneficial to provide a sufficient opening around the reel 100 and in the vicinity of the ledge 80 to accommodate conventional couplings that might be secured to either the vacuum hose 12 or the pressure hose 14.

In order to secure the vacuum hose 12 and pressure hose 14 within the support 10, there is provided a clamp, indicated generally by the numeral 120. Clamp 120 is connected to the frame structure 50 by a pivot pin 122. Forming a part of the clamp 120 is a first member or cross member 124. Cross member 124 is pivotally connected between the legs 82 and 84 by the pivot pin 122. Formed or secured to the underside of cross member 124 about one end portion is a pad or engaging surface 126. As will be appreciate from subsequent portions of this disclosure, the pad 126 is adapted to engage, in this case, the upper portion of the pressure hose 14 when the same is held within the support 10. To positively secure or hold the pressure hose 14 in place, it is contemplated that the underside of the pad 126 would include a frictional surface that would tend to engage the pressure hose 14 and provide a positive holding or securing surface. Pad 126 can be constructed of various materials such as an elastomember, rubber, foam, plastic or any other suitable material.

Figure 5:
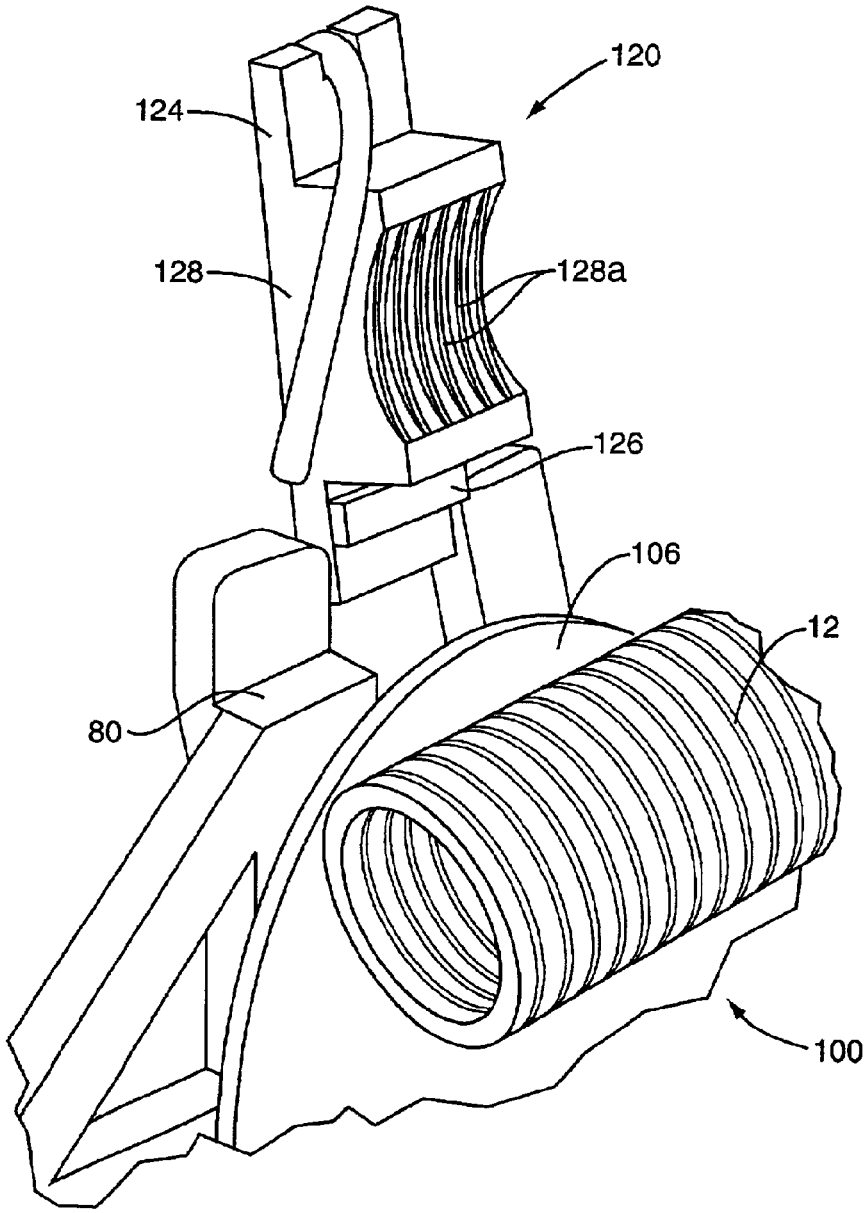
FIG. 5 is a fragmentary perspective view showing a portion of the vacuum hose and a clamp in an open or unclamped position.

Disposed inwardly on the cross member 124 is a central portion 128. The central portion 128 includes a curved surface for engaging the upper portion of the vacuum hose 12. Typically, as illustrated in FIG. 5, the vacuum hose 12 would include a series of axially spaced circular indentions formed about the outer surface of the hose. The central portion 28 extending downwardly from the cross member 124 could be provided with a series of spaced protrusions 128*a*, with the protrusions being spaced according to the indentions in the vacuum hose 12 such that when the clamp 120 is clamped onto the frame structure 50, the protrusions 128*a* extending from the central portion 128 would project into the indentions surrounding the outer surface of the pressure hose 12. This would effectively lock or secure the pressure hose 12 within the frame structure 50 of the support 10.

Figure 4:
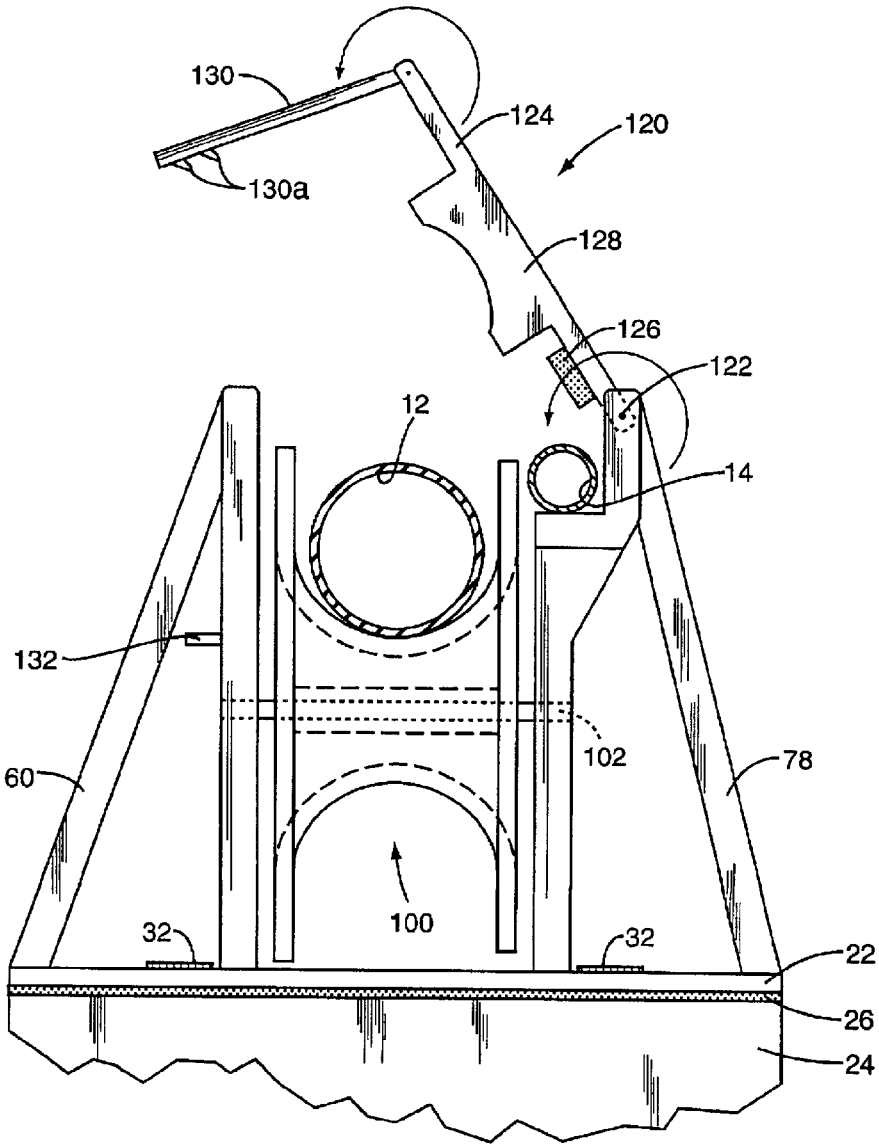
FIG. 4 is a fragmentary rear elevational view illustrating the movement of the clamp for securing the pressure and vacuum hoses within the support.

Clamp 120 is adapted to be moved between a clamped position (FIG. 1) and an unclamped position (FIG. 4). In order to secure the clamp 120 in a secure position, there is provided a latch for latching the cross member 124 to the frame structure 50. The latch includes a latch arm 130 that is pivotally mounted to the cross member 124. Latch arm 130 includes a series of latch bars 130*a* that extend outwardly from the latch arm. Preferably latch arm 130 is of a elastomember or rubber construction and as such is extendable or stretchable. Secured to one side of the frame structure 50 is a latch receiver 132. Receiver 132 would typically include a slot formed therein adapted to receive the latch arm 130. The clamp 120 can be placed in a clamped and secured position by effectively pulling down or stretching the latch arm 130 to a point where one of the latch bars 130*a* can be placed below the latch receiver 132. Typically, the latch bars 130*a* are each larger than the slot formed in the receiver 132. The latch arm itself can, however, be inserted into the slot formed in the receiver 132. Thus, by stretching the latch arm 130 downwardly to a point where one of the bars 130*a* lies below the receiver 132 and then inserting the latch arm within the slot within the receiver, it follows that the clamp 120 will be secured in the clamped position by the latch. It will be understood and appreciated by those skilled in the art that various latch assemblies can be utilized. The latch assembly just described is simply one example of a design that can be utilized to secure the clamp 120 in a locked position.

As discussed herein before, the support 10 is useful in supporting and holding one or more hoses of a carpet cleaning system. While the support 10 may be utilized to receive and hold other types of hoses, it is contemplated that one particular use of the present invention would entail receiving and holding the vacuum hose 12 and pressure hose 14 of a conventional carpet cleaning system. Further, the support 10 can be secured or supported on various structures, especially structures associated with a building housing the carpet or floors to be cleaned by carpet cleaning systems. FIG. 6 illustrates one exemplary use of the present invention. There, the support 10 is mounted or secured to a railing structure 150 that is formed about an upper story balcony area of a building. Note that the base unit 16 of the carpet cleaning system is disposed outside the building and that that hoses 12 and 14 are directed to the support 10 which is in turn secured to the railing structure 150. Hoses 12 and 14 extend from the support 10 inwardly within the building or dwelling to where the hoses connect to a conventional floor or carpet cleaning wand 18.

Prior to the hoses 12 and 14 being secured within support 10, the support 10 is mounted, in this case, to the railing structure 150. This is basically accomplished by securing the upper loops 30 around the top railing 152 of the railing structure and securing the lower loop 34 around a series of banisters or vertical members 154 forming a part of the railing structure 150. In the example shown in FIG. 6, the support 10 is mounted such that the side 24 of the base 20 faces the base unit 16. It is appreciated that the support 10 can be mounted in a reverse fashion where the side 24 of the base 20 faces the wand 18. In any event, after the base 20 has been secured to the railing structure 150, the clamp 120 is moved to an unclamped position which essentially leaves the top portion of the support 10 open. This enables the operator of the carpet cleaning system to insert the pressure hose 14 downwardly onto the reel 100 and to lay or position the pressure hose 14 on the ledge 80 that is disposed adjacent the reel 100. Thereafter, the clamp 120 can be swung from the unclamped position across the top of the vacuum hose 12 and pressure hose 14, and the latch can be secured. It is appreciated that the latch would be adjusted to where the cross member 124 is pulled downwardly into secure engagement with the upper surfaces of the vacuum hose 12 and pressure hose 14. In particular, the pad 126 is pulled or pushed into secure engagement with the underlying pressure hose 14 and the protrusions 128*a* extending from the central portion 128 of the clamp 120 extend downwardly into the indentions formed in the vacuum hose 12. Thus, when the clamp is secured in the locked or clamped position, both the vacuum hose 12 and pressure hose 14 are securely held within the support. This enables the operator to move the wand 18 freely about the floor or carpet being cleaned. It is appreciated that when securing the vacuum hose 12 and pressure hose 14 to the support 10, that the operator can pull a sufficient length of the hoses towards the carpet or floor cleaning area such that the operator will have sufficient freedom to clean a substantial floor area without having to adjust the position of the hoses within the support 10.

In many cases, the support 10 of the present invention will be used in cases where the operator is cleaning a floor or carpet located on the second, third, or fourth story of a building, for example. In these cases, once the support 10 has been secured to a structure such as a railing structure 150, the operator will simply hand carry a length of the pressure hose 14, or in some cases a length of the vacuum hose 12, to the location of the support 10. Then the operator will drop one of the hoses downwardly towards the ground area and thereafter will couple the dropped hose to the other hose by the use of tape or other type of coupling. Then by pulling the dropped hose upwardly, the operator will be able to pull the remaining hose upwardly to a position adjacent the support 10. Then, of course, the operator can secure both hoses to the support 10.

It is appreciated that the present invention has many advantages. It enables carpet cleaning operators to easily and conveniently clean carpets and floors especially on levels that are disposed higher than ground level. Once the hoses are secured within the support 10, then the hoses will not move back and forth over the railing structure 150 and accordingly, will not damage the railing structure or any other structure that the support 10 is mounted on.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A support for supporting a vacuum hose and a pressure hose that form a part of carpet cleaning system, the support comprising: a frame structure; a reel rotatably mounted to the frame structure for engaging and supporting the vacuum hose; a pressure hose area for receiving and supporting the pressure hose; a clamp mounted to the frame structure for engaging the vacuum hose and pressure hose and securing the vacuum hose and pressure hose to the support; and means for securing the support to a railing wherein the means for securing the support to the railing includes a flexible first connector adapted to connect to a generally horizontal rail that forms a part of the railing, and a second connector adapted to connect to one or more banisters that form a part of the railing.

2. The vacuum hose and pressure hose support of claim 1 wherein the frame structure includes a railing support adapted to be secured to a railing.

3. The vacuum hose and pressure hose support of claim 2 wherein the railing support is generally L-shaped.

4. The vacuum hose and pressure hose support of claim 1 wherein the first connector includes a first flexible tie adapted to extend from the frame structure of the support and wherein the first connector provides a hook and loop fastener for securing the first flexible tie around a portion of the railing; and wherein the second connector includes a second flexible tie for extending around a portion of the railing and connecting thereto via hook and loop fasteners.

5. The vacuum hose and pressure hose support of claim 1 wherein the clamp is moveable between a clamped position and an unclamped position, and wherein in the unclamped position, the support includes an open top that permits both the vacuum hose and the pressure hose to be inserted into the support through the open top, and wherein in a clamped position, the clamp extends over the top of the pressure and vacuum hoses and secures the hoses within the support.

6. The vacuum hose and pressure hose support of claim 1 wherein the pressure hose area is disposed adjacent the reel and wherein the clamp is an overhead clamp that is pivotally connected to the frame structure and moveable between clamp and unclamped positions and wherein in the clamped position the overhead clamp extends over and engages a top portion of both the vacuum hose and pressure hose.

7. The vacuum hose and pressure hose support of claim 6 wherein the pressure hose area includes a ledge for receiving and supporting the pressure hose and wherein the ledge is spaced above a lower portion of the reel.

8. The vacuum hose and pressure hose support of claim 1 wherein the clamp is moveable between a clamp position and an unclamped position, and wherein the clamp includes a vacuum hose engaging surface for engaging the vacuum hose when in the clamped position and a pressure hose engaging surface for engaging the pressure hose when in the clamped position.

9. The vacuum hose and pressure hose support of claim 8 including a generally curved shaped surface for engaging and extending around at least a portion of the vacuum hose when the clamp assumes the clamped position.

10. The vacuum hose and pressure hose support of claim 8 wherein the surface for engaging the pressure hose includes a frictional surface that engages the pressure hose so as to generally prevent the pressure hose from moving with respect to the support when the clamp assumes the clamped position.

11. The vacuum hose and pressure hose support of claim 1 wherein the clamp is moveable between clamped and unclamped positions and includes a first member for engaging both the vacuum hose and pressure hose when in the clamped position, and further includes a latch for latching the clamp in the clamped position.

12. The vacuum hose and pressure hose support of claim 11 wherein the first member is pivotally connected to the frame structure, and wherein the latch includes a latching member pivotally connected to the first member.

13. A support adapted to be secured to a railing structure for supporting a vacuum hose and a pressure hose that form a part of a carpet cleaning system, the support comprising: a base for resting adjacent the railing structure; at least one connector associated with the base for extending to and connecting to the railing structure so as to secure the base to the railing structure; a frame structure secured to the base; the frame structure including an area for receiving the vacuum hose of the carpet cleaning system; the frame structure further including an area for receiving the pressure hose of the carpet cleaning system; a fastener for securing the vacuum hose and pressure hose of the carpet cleaning system within the areas for receiving the vacuum hose and pressure hose; and wherein the railing structure that supports the support includes a top rail and a series of vertical members disposed below the top rail, and wherein the base includes a first member for extending over the top rail and a second member that extends alongside a portion of the railing structure.

14. The support of claim 13 wherein the fastener includes a clamp for securely clamping the vacuum hose and pressure hose to the support, the clamp being moveable between a clamp position and an unclamped position.

15. The support of claim 14 wherein the clamp includes a member pivotally connected to the frame structure and operative to engage both the pressure hose and the vacuum hose when the clamp assumes the clamped position.

16. The support of claim 15 wherein the clamp includes a latch for latching the clamp in the clamp position.

17. The support of claim 15 wherein the member of the clamp for engaging the vacuum hose and pressure hose includes a first surface for engaging the vacuum hose and preventing the vacuum hose from substantially moving with respect to the support, and a second surface for engaging and holding the pressure hose such that both the pressure hose and vacuum hose are maintained relatively stationary within the support.

18. The support of claim 13 wherein the support includes a reel and wherein the area for receiving the vacuum hose includes a portion of the reel.

19. The support of claim 18 including a ledge that forms a part of the area for receiving the pressure hose such that when the pressure hose is secured within the support, a portion of the pressure hose rests on the ledge.

20. The support of claim 13 wherein the base is of a generally L-shaped configuration.

21. The support of claim 13 wherein the base includes a padding for engaging the railing structure.

22. A method of supporting a vacuum hose and a pressure hose, forming a part of a carpet cleaning system, between a base unit and an application wand wherein the base unit and the application wand also form a part of the carpet cleaning system, the method comprising: securing a support intermediately between the base unit and the floor or carpet to be cleaned; placing a portion of the vacuum hose and pressure hose of the carpet cleaning system within the support; securing the vacuum hose and pressure hose within the support such that the vacuum hose and pressure hose are held within the support; performing a floor or carpet cleaning operation with the wand while the pressure hose and vacuum hose are secured with the support; and wherein the support includes a rail and a ledge with the rail being adapted to support the vacuum hose and the ledge being adapted to support the pressure hose, and wherein the method further includes securing the vacuum hose and pressure hose within the support by engaging and clamping the hose such that the vacuum hose is retained between the clamp and the rail and the pressure hose is retained between the clamp and the ledge.

23. The method of claim 22 including securing the support to a railing structure associated with a building having the floor or carpet to be cleaned.

24. The method of claim 22 including cleaning a floor or carpet on a second story, or a story there above, of a building by securing the support to a railing structure located above a ground level such that during the floor or carpet cleaning operation, the vacuum hose and pressure hose are secured within the support that is turn secured to the railing structure.

25. The method of claim 22 including securing the support to an upper level of a building where the upper level is located at least as high as a second story level, directing one of the hoses downwardly from the upper level; securing the hose directed downwardly to the other hose and pulling both hoses upwardly to the upper level; and securing both hoses within the support.

26. The method of claim 25 wherein after the carpet cleaning operation is completed, at least one hose is engaged with a reel and allowed to pass over the reel as the one hose is returned to a lower level.

27. The method of claim 22 wherein securing the vacuum hose and pressure hose within the support includes engaging the vacuum hose and pressure hose with a moveable clamp and clamping the clamp to a frame structure associated with the support wherein the clamp engages both the pressure hose and vacuum hose and secures the hoses within the support.

28. A support for receiving and holding a vacuum hose and a pressure hose forming a part of a carpet cleaning system, comprising:

a base adapted to be secured to a part of a building structure;

a frame structure disposed on the base;

a reel rotatably mounted to the frame structure for receiving one of the hoses;

a hose receiving area disposed adjacent the reel and including a hose support for receiving the other hose;

the support including an open top area disposed over the reel and hose receiving area such that both the vacuum hose and the pressure hose can be inserted into the support through the open top; and a clamp movably mounted to the frame structure and movable from an unclamped position to a clamped position, in the clamped position the clamp engaging upper portions of both the vacuum hose and the pressure hose such that in the clamped position the hoses are held within the support; and wherein the hose receiving area includes a ledge that is spaced upwardly from the lower portion of the rail.

29. The support of claim 28 wherein the clamp is pivotally connected to the frame structure and includes a first member that in a clamped position extends over the vacuum hose and pressure hose and engages the same and holds the pressure hose and vacuum hose downwardly in the support, wherein the support includes a latch member that is pivotally connected to the first member and in a clamped position extends downwardly for engagement with a mating latch receiver.

30. The support of claim 28 wherein the base includes an L-shaped structure that extends over a top rail of the railing structure and downwardly adjacent vertical member forming a part of the railing structure; and wherein the L-shaped structure is provided with at least two connectors for connecting to the top rail and to one or more vertical members of the railing structure such that the support is securely held on the railing structure.

31. A support for supporting a vacuum hose and a pressure hose that form a part of carpet cleaning system, the support comprising: a frame structure; a reel rotatably mounted to the frame structure for engaging and supporting the vacuum hose; a pressure hose area for receiving and supporting the pressure hose; a clamp mounted to the frame structure for engaging the vacuum hose and pressure hose and securing the vacuum hose and pressure hose to the support, wherein the pressure hose area is disposed adjacent to the reel and wherein the clamp is an overhead clamp that is pivotally connected to the frame structure and movable between clamped and unclamped positions and wherein in the clamped position the overhead clamp extends over and engages a top portion of both the vacuum hose and the pressure hose, and wherein the pressure hose area includes a ledge for receiving and supporting the pressure hose and wherein the ledge is spaced above a lower portion of the reel.

32. A support adapted to be secured to a railing structure for supporting a vacuum hose and a pressure hose that form a part of a carpet cleaning system, the support comprising: a base for resting adjacent the railing structure; at least one connector associated with the base for extending to and connecting to the railing structure so as to secure the base to the railing structure; a frame structure secured to the base; the frame structure including an area for receiving the vacuum hose of the carpet cleaning system; the frame structure further including an area for receiving the pressure hose of the carpet cleaning system; a fastener for securing the vacuum hose and pressure hose of the carpet cleaning system within the areas for receiving the vacuum hose and pressure hose; wherein the fastener includes a clamp for securely clamping the vacuum hose and pressure hose to the support, the clamp being movable between a clamped position and an unclamped position; wherein the clamp includes a member pivotally connected to the frame structure and operative to engage both the pressure hose and the vacuum hose when the clamp assumes the clamped position; and wherein the member of the clamp for engaging the vacuum hose and pressure hose includes a first surface for engaging the vacuum hose and preventing the vacuum hose from substantially moving with respect to the support, and a second surface for engaging and holding the pressure hose such that both the pressure hose and the vacuum hose are maintained relatively stationary within the support.

33. A support adapted to be secured to a railing structure for supporting a vacuum hose and a pressure hose that form a part of a carpet cleaning system, the support comprising: a base for resting adjacent the railing structure; at least one connector associated with the base for extending to and connecting to the railing structure so as to secure the base to the railing structure; a frame structure secured to the base; the frame structure including an area for receiving the vacuum hose of the carpet cleaning system; the frame structure further including an area for receiving the pressure hose of the carpet cleaning system; a fastener for securing the vacuum hose and pressure hose of the carpet cleaning system within the areas for receiving the vacuum hose and pressure hose; wherein the support includes a reel and wherein the area for receiving the vacuum hose includes a portion of the reel such that when the vacuum hose is retained within the support, a portion of the vacuum hose engages the reel; and wherein the support includes a ledge that forms a part of the area for receiving the pressure hose such that when the pressure hose is secured within the support, a portion of the pressure hose rests on the ledge.

* * * * *